US009994987B2

(12) United States Patent
Im et al.

(10) Patent No.: US 9,994,987 B2
(45) Date of Patent: Jun. 12, 2018

(54) WASHING MACHINE AND CONTROL METHOD THEREOF

(71) Applicant: LG ELECTRONICS INC., Seoul (KR)

(72) Inventors: Myunghun Im, Seoul (KR); Jinho Kim, Seoul (KR); Sooyoung Oh, Seoul (KR); Changoh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 608 days.

(21) Appl. No.: 14/331,816

(22) Filed: Jul. 15, 2014

(65) Prior Publication Data

US 2015/0020317 A1 Jan. 22, 2015

(30) Foreign Application Priority Data

Jul. 18, 2013 (KR) ..... 10-2013-0084821

(51) Int. Cl.

| | |
|---|---|
| ***D06F 33/02*** | (2006.01) |
| ***D06F 37/36*** | (2006.01) |
| ***D06F 37/20*** | (2006.01) |

(52) U.S. Cl.

CPC ..... *D06F 33/02* (2013.01); *D06F 37/203* (2013.01); *D06F 37/36* (2013.01); *D06F 2202/065* (2013.01); *D06F 2204/065* (2013.01); *D06F 2222/00* (2013.01)

(58) Field of Classification Search

CPC ..... D06F 33/02

See application file for complete search history.

(56) References Cited

U.S. PATENT DOCUMENTS 4,513,464 A * 4/1985 Rettich ..... D06F 37/203 68/12.06

2005/0283918 A1 12/2005 Zhang et al.

FOREIGN PATENT DOCUMENTS

| | | | |
|---|---|---|---|
| CN | 1459529 | A | 12/2003 |
| CN | 1676734 | A | 10/2005 |
| CN | 101586300 | A | 11/2009 |
| EP | 1362946 | A2 | 11/2003 |
| EP | 2128324 | A1 | 12/2009 |
| EP | 2 527 511 | A1 | 11/2012 |
| EP | 2527511 | A1 | 11/2012 |

* cited by examiner

*Primary Examiner* — Jason Ko

(74) *Attorney, Agent, or Firm* — Dentons US LLP

(57) ABSTRACT

Disclosed herein are a washing machine and a control method thereof. The control method includes sensing a first unbalance amount of a drum in which laundry is received while rotating the drum at a first rotational velocity, sensing a second unbalance amount of the drum while accelerating the drum to a second rotational velocity, when the first unbalance amount is allowed, and accelerating the drum to a target rotational velocity, when the second unbalance amount is allowed.

11 Claims, 7 Drawing Sheets

(a)

(b)

WASHING MACHINE AND CONTROL METHOD THEREOF

CROSS-REFERENCE TO RELATED APPLICATION

This application claims the benefit of Korean Patent Application No. 10-2013-0084821, filed on Jul. 18, 2013 in the Korean Intellectual Property Office, the disclosure of which is incorporated herein by reference.

BACKGROUND OF THE INVENTION

1. Field of the Invention

The present invention relates to a washing machine and a control method thereof and, more particularly, to a washing machine in which balancing is efficiently performed and a control method thereof.

2. Description of the Related Art

In general, a washing machine is an apparatus which washes clothes and bedclothes (hereinafter, referred to as "laundry") using water, detergent, and mechanical actions through washing, rinsing, and spin-drying processes so as to remove contaminants from the laundry.

Washing machines are divided into an agitator type, a pulsator type, and a drum type.

An agitator type washing machine washes laundry by rotating a washing bar, rising at the center of a washing tub, in leftward and rightward directions, the pulsator type washing machine washes laundry using frictional force between a water current and the laundry by rotating a disc-type rotation blade, formed at the lower portion of a washing tub, in the leftward and rightward directions, and a drum type washing machine washes laundry by putting water, detergent, and the laundry into a drum and then rotating the drum.

In the drum washing machine, a tub containing wash water is mounted in a cabinet forming the external appearance of the drum washing machine, a drum receiving laundry is disposed in the tub, a driving unit to rotate the drum is mounted on the rear surface of the tub, and a drive shaft passing through the tub and connected to the rear surface of the drum is axially installed on the driving unit. Lifters are mounted in the drum and lift the laundry during rotation of the drum.

In a washing machine, laundry is disposed to one side due to tangling of the laundry and thus, eccentricity in which one side of the drum becomes heavy occurs. If the drum is rotated at a high velocity under the condition that the laundry is disposed to one side (for example, when the laundry is spin-dried), vibration and noise are generated due to unbalance between the geometric center of a rotary axis of the drum and the actual center of gravity of the drum. In order to reduce such vibration and noise, a device to reduce unbalance of the drum, i.e., a balancer, is installed.

A washing machine provided with such a balancer requires proper balancing.

SUMMARY OF THE INVENTION

An object of the present invention is to provide a washing machine in which balancing is efficiently performed and a control method thereof.

The objects of the present invention are not limited to the above-mentioned objects and other objects that have not been mentioned above will become evident to those skilled in the art from the following description.

To achieve the above objects, there is provided a control method of a washing machine according to an exemplary embodiment of the present invention, including sensing a first unbalance amount of a drum in which laundry is received while rotating the drum at a first rotational velocity, sensing a second unbalance amount of the drum while accelerating the drum to a second rotational velocity, when the first unbalance amount is allowed, and accelerating the drum to a target rotational velocity, when the second unbalance amount is allowed.

To achieve the above objects, there is provided a washing machine according to an exemplary embodiment of the present invention, including a drum receiving laundry and rotated, a motor rotating a drum, a balancer balancing the drum in which the laundry is received, a velocity detection unit sensing the actual rotational velocity of the drum, and a controller receiving the actual rotational velocity sensed by the velocity detection unit and controlling the motor, wherein the controller senses a first unbalance amount of the drum while controlling the motor to regularly rotate the drum at a first rotational velocity, senses a second unbalance amount of the drum while controlling the motor to accelerate the drum to a second rotational velocity, when the first unbalance amount is allowed, and controls the motor to accelerate the drum to a target rotational velocity, when the second unbalance amount is allowed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

The advantages and features of the present invention, and the way of attaining them, will become apparent with reference to embodiments described below in conjunction with the accompanying drawings. Reference will now be made in detail to the preferred embodiments of the present invention, examples of which are illustrated in the accompanying drawings. Wherever possible, the same reference numbers will be used throughout the drawings to refer to the same or like parts.

Hereinafter, a washing machine and a control method thereof in accordance with embodiments of the present invention will be described with reference to the accompanying drawings.

Figure 1:
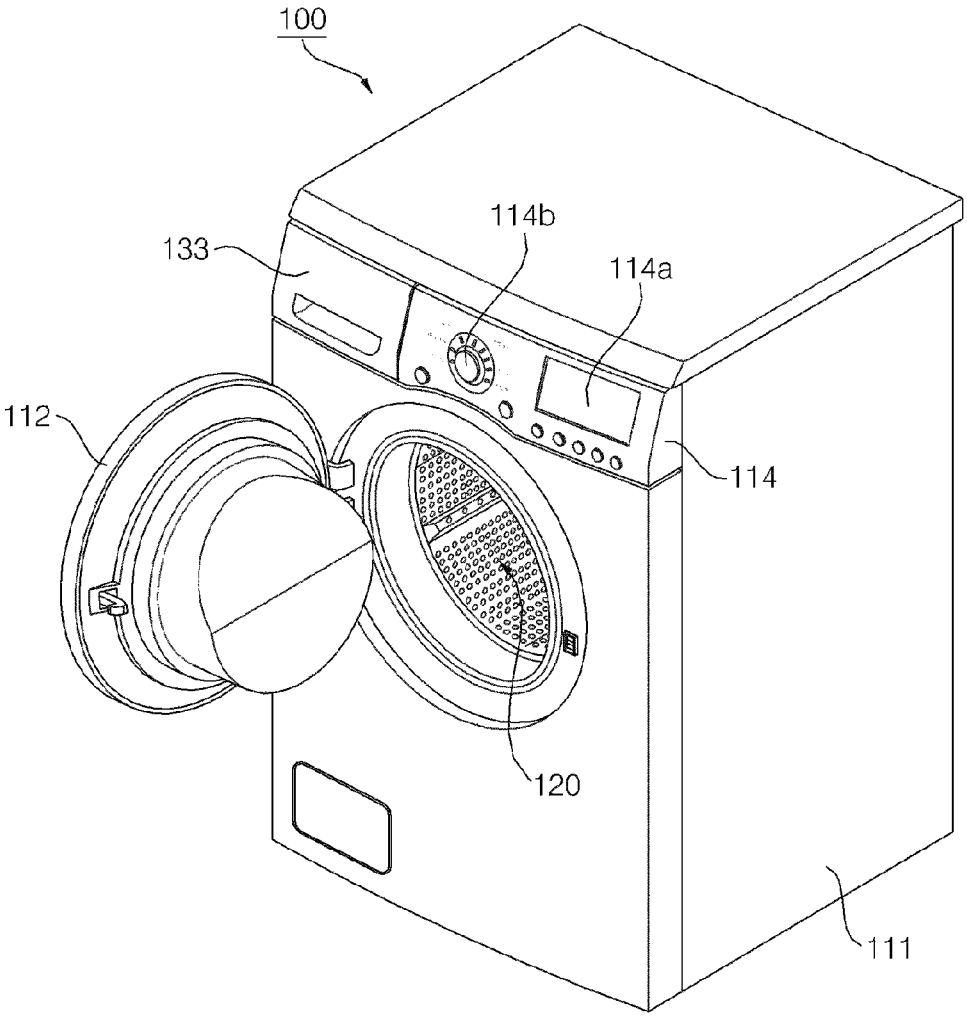
FIG. 1 is a perspective view of a washing machine in accordance with one embodiment of the present invention.
Figure 2:
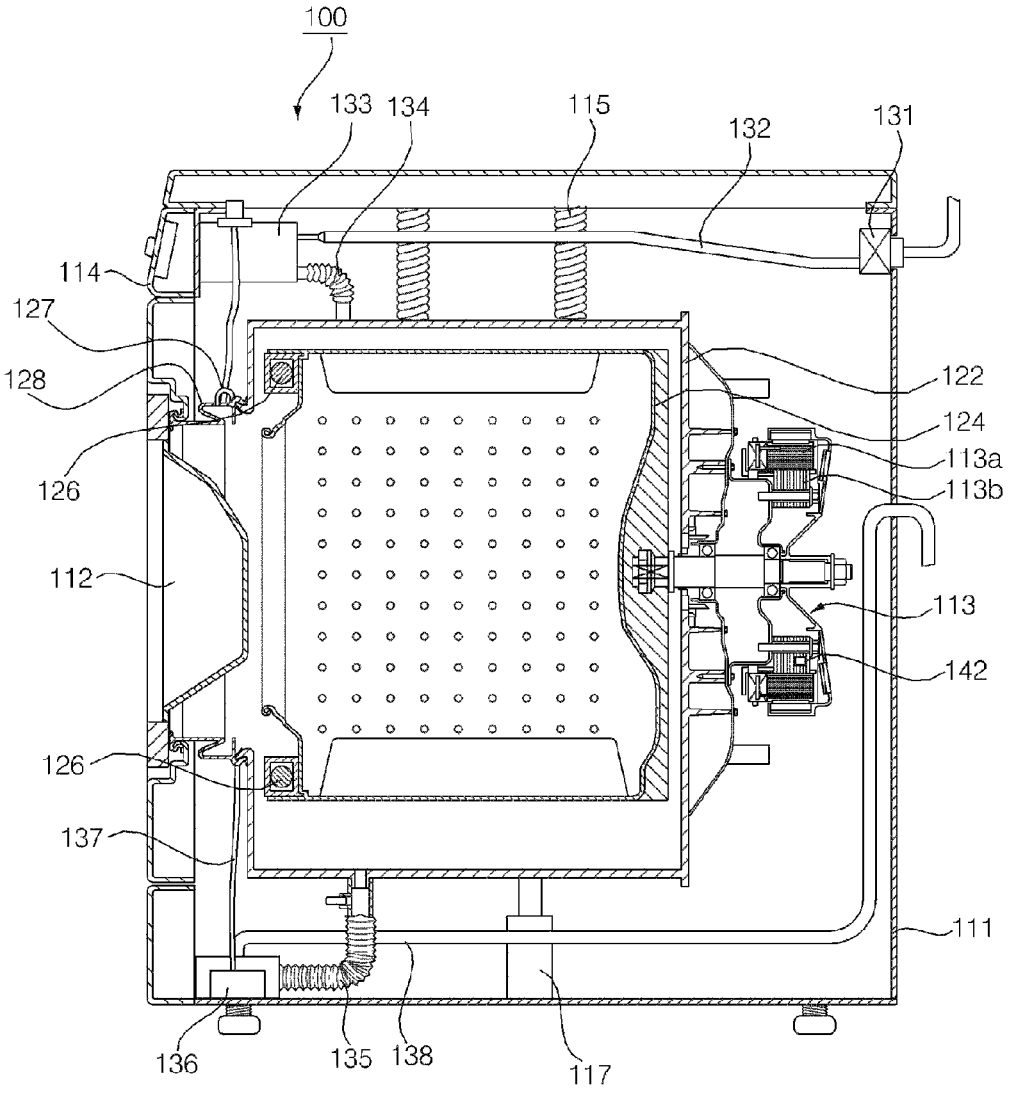
FIG. 2 is a longitudinal-sectional view of the washing machine of FIG. 1.

FIG. 1 is a perspective view of a washing machine in accordance with one embodiment of the present invention and FIG. 2 is a longitudinal-sectional view of the washing machine of FIG. 1.

A washing machine 100 in accordance with one embodiment of the present invention includes a cabinet 111 forming the external appearance of the washing machine 100, a door 112 opening and closing one side of the cabinet 111 so that laundry may enter into and be withdrawn from the cabinet 111, a tub 122 disposed within the cabinet 111 and supported by the cabinet 111, a drum 124 disposed within the tub 122, containing laundry and rotated, a motor 113 to rotate the drum 124, a detergent box 133 containing detergent, and a control panel 114 receiving user input and displaying the state of the washing machine 100.

The cabinet 111 is provided with a laundry entrance 120. The door 112 is rotatably combined with the cabinet 111 so as to open and close the laundry entrance 120. The control panel 114 is provided on the cabinet 111. The detergent box 133 is provided on the cabinet 111 so as to be withdrawn from within the cabinet 111.

The tub 122 is disposed so as to absorb impact using springs 115 and a damper 117 within the cabinet 111. The tub 122 receives wash water. The drum 124 is disposed within the tub 122.

The drum 124 is rotated under the condition that laundry is received in the drum 124. A plurality of through holes is formed on the drum 124 so that wash water may pass through the through holes. Lifters 25 lifting the laundry to a designated height during rotation of the drum 124 may be disposed on the inner wall of the drum 124. The drum 124 is rotated by rotary force transmitted from the motor 113.

A balancer 126 balances the drum 216 in which the laundry is received. The balancer 126 is provided at the circumference of the drum 124 and is balanced with the laundry when the laundry is eccentrically disposed and thus balances the drum 126.

If the drum 126 is rotated under the condition that the laundry is eccentrically disposed, vibration and noise are generated due to unbalance between the geometric center of a rotary axis of the drum 124 and the actual center of gravity of the drum 124. The balancer 126 causes the actual center of gravity of the drum 124 to be close to the center of rotation of the drum 124, thus reducing unbalance of the drum 124.

The balancer 126 may be provided at the front portion and/or the rear portion of the drum 124. In this embodiment, the balancer 126 is provided at the front portion of the drum 124. When the drum 124 is rotated, the laundry received in the drum 124 is generally concentrated at the inner portion, i.e., the rear portion, of the drum 124. Therefore, in order to be balanced with the laundry concentrated at the rear portion of the drum 124, the balancer 126 may be provided at the front portion of the drum 124.

The balancer 126 includes an inner member having a designated weight so that the center of gravity of the drum 124 may vary, and a path along which the inner member moves in the circumferential direction is provided in the balancer 126. The inner member of the balancer 126 moves to the opposite side to the center of gravity of the laundry along the moving path and thus balances the drum 124.

The balancer 126 may be a liquid balancer including a liquid having a designated weight or a ball balancer including balls having a designated weight. In this embodiment, the balancer 126 includes balls and a filling fluid.

A gasket 128 seals a gap between the tub 122 and the cabinet 111. The gasket 128 is disposed between the entrance of the tub 122 and the laundry entrance 120. The gasket 128 absorbs impact transmitted to the door 112 during rotation of the drum 124 and prevents wash water in the tub 122 from leaking to the outside. A circulation nozzle 127 through which wash water flows into the drum 124 may be connected to the gasket 128.

The motor 113 rotates the drum 124. The motor 113 may rotate the drum 124 at various velocities or in various directions. The motor 113 includes a stator 113*a* on which coils are wound and a rotor 113*b* rotated by electromagnetic interaction with the coils.

The stator 113*a* includes a plurality of wound coils. The rotor 113*b* includes a plurality of magnets generating electromagnetic interaction with the coils. The rotor 113*b* is rotated by the electromagnetic interaction between the coils and the magnets, and rotary force of the rotor 113*b* is transmitted to the drum 124 and thus rotates the drum 124.

A velocity detection unit 142 measuring the velocity of the rotor 113*b* is provided on the motor 113. The velocity detection unit 142 measures the actual rotational velocity of the drum 126 by measuring the velocity of the rotor 113*b*. The velocity detection unit 142 may be a Hall sensor generating an on/off signal by rotation of the rotor 113*b*.

The detergent box 133 receives detergent, such as a laundry detergent, a fabric rinse, or bleach. The detergent box 133 may be provided on the front surface of the cabinet 111 so as to be withdrawn from within the cabinet 111. The detergent in the detergent box 133 is mixed with wash water and flows into the tub 122 when the wash water is supplied.

In the cabinet 111, a water supply valve 131 adjusting inflow of wash water from an external water source, a water supply path 132 along which the wash water supplied from the water supply valve 131 flows to the detergent box 133, and a water supply pipe 134 along which a mixture of the detergent and the wash water from the detergent box 133 flows to the inside of the tub 122 may be provided.

Further, in the cabinet 111, a drain pipe 135 to which the wash water in the tub 122 is discharged, a pump 136 discharging the wash water in the tub 122 to the drain pipe 135, a circulation path 137 circulating the wash water, a circulation nozzle 127 through which the wash water flows to the inside of the drum 125, and a drain path 138 through which the wash water is discharged to the outside of the washing machine 100 may be provided. According to embodiments, the pump 136 may be divided into a circulation pump and a drain pump and the circulation pump and the drain pump may be respectively connected to the circulation path 137 and the drain path 138.

The control panel 114 may include an input unit 114*b* through which a user may select one of washing courses or input various operation instructions, such as an operation time of each cycle and reservation, and a display unit 114*a* displaying the operation state of the washing machine 100.

Hereinafter, operation of the above-described washing machine in accordance with the embodiment of the present invention will be described.

A user opens the door 122, puts laundry into the drum 124, and operates the washing machine 100 by manipulating the control panel 114. When the washing machine 100 is operated, a washing cycle in which the laundry is soaked in wash water containing a laundry detergent and contaminants are removed form the laundry by rotating the drum 124, a rinsing cycle in which the laundry is soaked in wash water containing a fabric rinse and the remaining laundry detergent is removed from the laundry by rotating the drum 124, and a spin-drying cycle in which the laundry is dehydrated by rotating the drum 124 at a high velocity are sequentially performed. In each cycle, a water supply stage, a washing stage, a rinsing stage, a drain stage, a spin-drying stage, and a drying stage are performed.

Figure 3:
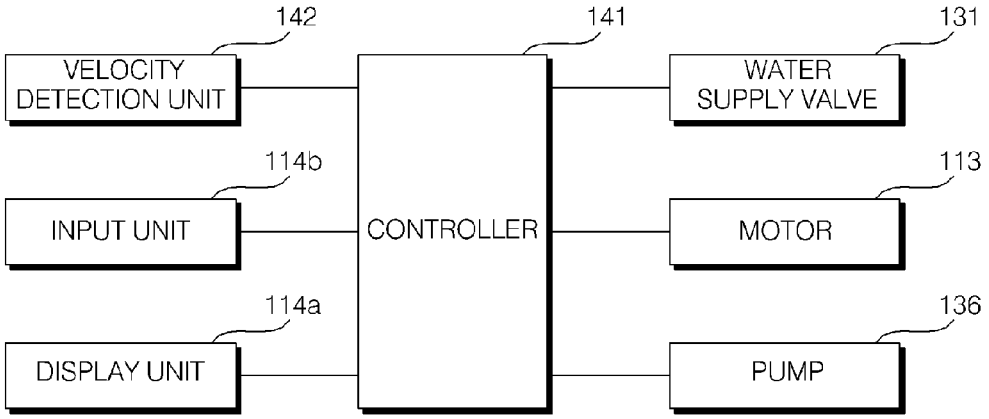
FIG. 3 is a block diagram of the washing machine in accordance with the embodiment of the present invention.
Figure 4:
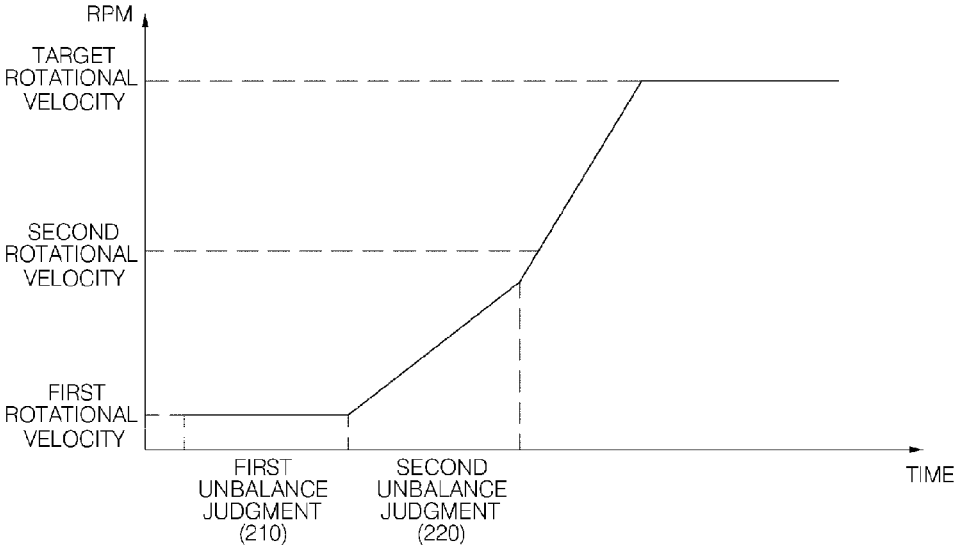
FIGS. 4(*a*) and 4(*b*) are graphs illustrating a control method of a washing machine in accordance with one embodiment of the present invention.
Figure 4:
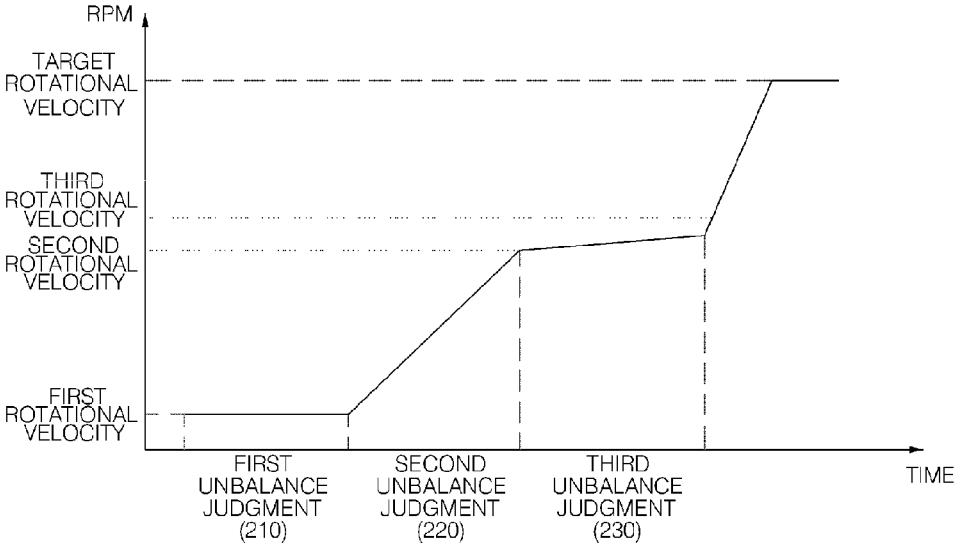

FIG. 3 is a block diagram of the washing machine in accordance with the embodiment of the present invention and FIGS. 4(*a*) and 4(*b*) are graphs illustrating a control method of a washing machine in accordance with one embodiment of the present invention.

In a control method of a washing machine which will be described later, during the washing cycle, the rinsing cycle, or the spin-drying cycle, the washing stage, the rinsing stage, and the spin-drying stage which require high-velocity rotation of the drum 124 may be performed.

The washing machine 100 in accordance with the embodiment of the present invention includes a controller 141 controlling the overall operation of the washing machine 100. The controller 141 receives the operation instructions input through the input unit 114*b*, receives the actual rotational velocity of the drum 124 sensed by the velocity detection unit 142, controls the water supply valve 131, the motor 113, and the pump 136, and displays the operation state of the washing machine 100 through the display unit 114*a*.

The controller 141 may be provided in the control panel 114. The controller 141 may include a microcomputer controlling the operation of the washing machine 100, a storage device, and other electronic components. The controller 141 determines whether or not each cycle is carried out according to a washing course selected by the user or whether or not water supply, washing, rinsing, drain, spin-drying and drying in each cycle are carried out, times taken to perform these stages, and the number of repetition of these stages, and controls the water supply valve 131, the motor 113, and the pump 136 to perform these stages of each cycle.

The controller 141 senses an unbalance amount of the drum 124 and judges whether or not the unbalance amount is allowed. A detailed description thereof will be given later with reference to FIGS. 4(*a*) and 4(*b*).

Hereinafter, the function of the washing machine in accordance with the embodiment of the present invention will be described with reference to FIGS. 4(*a*) and 4(*b*).

With reference to FIGS. 4(*a*) and 4(*b*), the control method of the washing machine in accordance with the embodiment of the present invention includes first unbalance judgment (Operation 210) in which a first unbalance amount of the drum 124 is sensed while the drum 124 is rotated at a first rotational velocity, second unbalance judgment (Operation 220) in which, when the first unbalance amount of the drum 124 is allowed in the first unbalance judgment (Operation 210), a second unbalance amount of the drum 124 is sensed while the drum 124 is accelerated to a second rotational velocity, and acceleration (Operation 240) in which, when the second unbalance amount of the drum 124 is allowed in the second unbalance judgment (Operation 220), the drum 124 is accelerated to a target rotational velocity.

The control method of the washing machine in accordance with the embodiment of the present invention may further include third unbalance judgment (Operation 230) in which, when the second unbalance amount of the drum 124 is not allowed until the drum 124 reaches the second rotational velocity in the second unbalance judgment (Operation 220), a third unbalance amount of the drum 124 is sensed while the drum 124 is accelerated to a third rotational velocity.

In the first unbalance judgment (Operation 210), the controller 141 controls the motor 113 to rotate the drum 124 at the regular first rotational velocity and senses the first unbalance amount of the drum 124. The controller 141 judges the first unbalance amount of the drum 124 within a first unbalance judgment time set while rotating the drum 124 at the first rotational velocity.

The first rotational velocity is a target velocity of the motor 113 ordered by the controller 141 but is not the actual rotational velocity of the motor 113. The first rotational velocity has a predetermined regular velocity value and is stored in the controller 141. The first rotational velocity may be a velocity at which the drum 124 is rotated under the condition that the laundry received in the drum 124 is not attached to the drum 124. In this embodiment, the first rotational velocity is 46 rpm.

The controller 141 judges whether or not the first unbalance amount of the drum 124 is allowed in the first unbalance judgment (Operation 210). A method of judging the first unbalance amount of the drum 124 in the first unbalance judgment (Operation 210) will be described later with reference to FIGS. 5 and 6.

When the first unbalance amount of the drum 124 is not allowed within the first unbalance judgment time, the controller 141 controls the motor 113 to decelerate the drum 124 and then to accelerate the drum 124 to the first rotational velocity and thus performs the first unbalance judgment (Operation 210) again while rotating the drum 124 at the first rotational velocity. According to embodiments, when the first unbalance amount of the drum 124 is not allowed within the first unbalance judgment time, the controller 141 may control the motor 113 to stop the drum 124 and then display a warning indicating that balancing is not carried out through the display unit 114*a*.

When the first unbalance amount of the drum 124 is allowed within the first unbalance judgment time, the controller 141 performs the second unbalance judgment (Operation 220).

In the second unbalance judgment (Operation 220), the controller 141 controls the motor 113 to accelerate the drum 124 to the second rotational velocity and senses the second unbalance amount of the drum 124. The second rotational velocity may be a velocity at which the drum 124 is rotated under the condition that the laundry received in the drum 124 is attached to the drum 124. In this embodiment, the second rotational velocity is 130 rpm. According to embodiments, the controller 141 may control the motor 113 according to an acceleration set in the second unbalance judgment (Operation 220) to accelerate the drum 124.

The controller 141 judges whether or not the second unbalance amount of the drum 124 is allowed in second unbalance judgment (Operation 220). A method of judging the second unbalance amount of the drum 124 in the second unbalance judgment (Operation 220) differs from the method of judging the first unbalance amount of the drum 124 in the first unbalance judgment (Operation 210) and a detailed description thereof will be given later with reference to FIG. 7.

When the second unbalance amount of the drum 124 is not allowed until the drum 124 reaches the second rotational velocity, the controller 141 performs the third unbalance judgment (Operation 230). According to embodiments, when the second unbalance amount of the drum 124 is not allowed in the second unbalance judgment (Operation 220), the controller 141 may control the motor 113 to decelerate the drum 124 and then perform the first unbalance judgment (Operation 210) again. Further, according to embodiments, when the second unbalance amount of the drum 124 is not allowed in the second unbalance judgment (Operation 220), the controller 141 may control the motor 113 to stop the drum 124 and then display a warning indicating that balancing is not carried out through the display unit 114*a*.

In the third unbalance judgment (Operation 230), the controller 141 controls the motor 113 to accelerate the drum 124 to a third rotational velocity and senses a third unbalance amount of the drum 124. The third rotational velocity is higher than the second rotational velocity. In this embodiment, the third rotational velocity is 150 rpm. The controller 141 may control the motor 113 so that the acceleration of the drum 124 in the third unbalance judgment (Operation 230) is lower than the acceleration of the drum 124 in the second unbalance judgment (Operation 220). In the third unbalance judgment (Operation 230), the controller 141 may control the motor 113 according to an acceleration set to be lower than the acceleration set in the second unbalance judgment (Operation 220) to accelerate the drum 124.

The controller 141 judges whether or not the third unbalance amount of the drum 124 is allowed in the third unbalance judgment (Operation 230). A method of judging the third unbalance amount of the drum 124 in the third unbalance judgment (Operation 230) is the same as the method of judging the second unbalance amount of the drum 124 in the second unbalance judgment (Operation 220) and a detailed description thereof will be given later with reference to FIG. 7.

When the third unbalance amount of the drum 124 is not allowed until the drum 124 reaches the third rotational velocity, the controller 141 may control the motor 113 to decelerate the drum 124 and then perform the first unbalance judgment (Operation 210) again, or to perform the second unbalance judgment (Operation 220) again. According to embodiments, when the third unbalance amount of the drum 124 is not allowed in the third unbalance judgment (Operation 230), the controller 141 may control the motor 113 to stop the drum 124 and then display a warning indicating that balancing is not carried out through the display unit 114*a*. Further, according to embodiments, when the third unbalance amount of the drum 124 is not allowed in the third unbalance judgment (Operation 230), the controller 131 may control the motor 113 to accelerate the drum 124 to a fourth rotational velocity higher than the third rotational velocity and judge a fourth unbalance amount of the drum 124, i.e., perform fourth unbalance judgment.

When the second unbalance amount or the third unbalance amount of the drum 124 is allowed in the second unbalance judgment (Operation 220) or in the third unbalance judgment (Operation 230), the controller 141 performs the acceleration (Operation 240).

As exemplarily shown in FIG. 4(*a*), when the second unbalance amount of the drum 124 is allowed before the velocity of the drum 124 reaches the second rotational velocity in the second unbalance judgment (Operation 220), the controller 141 immediately performs the acceleration (Operation 240).

As exemplarily shown in FIG. 4(*b*), when the third unbalance amount of the drum 124 is allowed before the velocity of the drum 124 reaches the third rotational velocity in the third unbalance judgment (Operation 230), the controller 141 immediately performs the acceleration (Operation 240).

In the acceleration (Operation 240), the controller 141 controls the motor 113 to accelerate the drum 124 to a target rotational velocity. After acceleration of the drum 124 to the target rotational velocity, the controller 141 may perform the washing, rinsing, or spin-drying stage.

Figure 5:
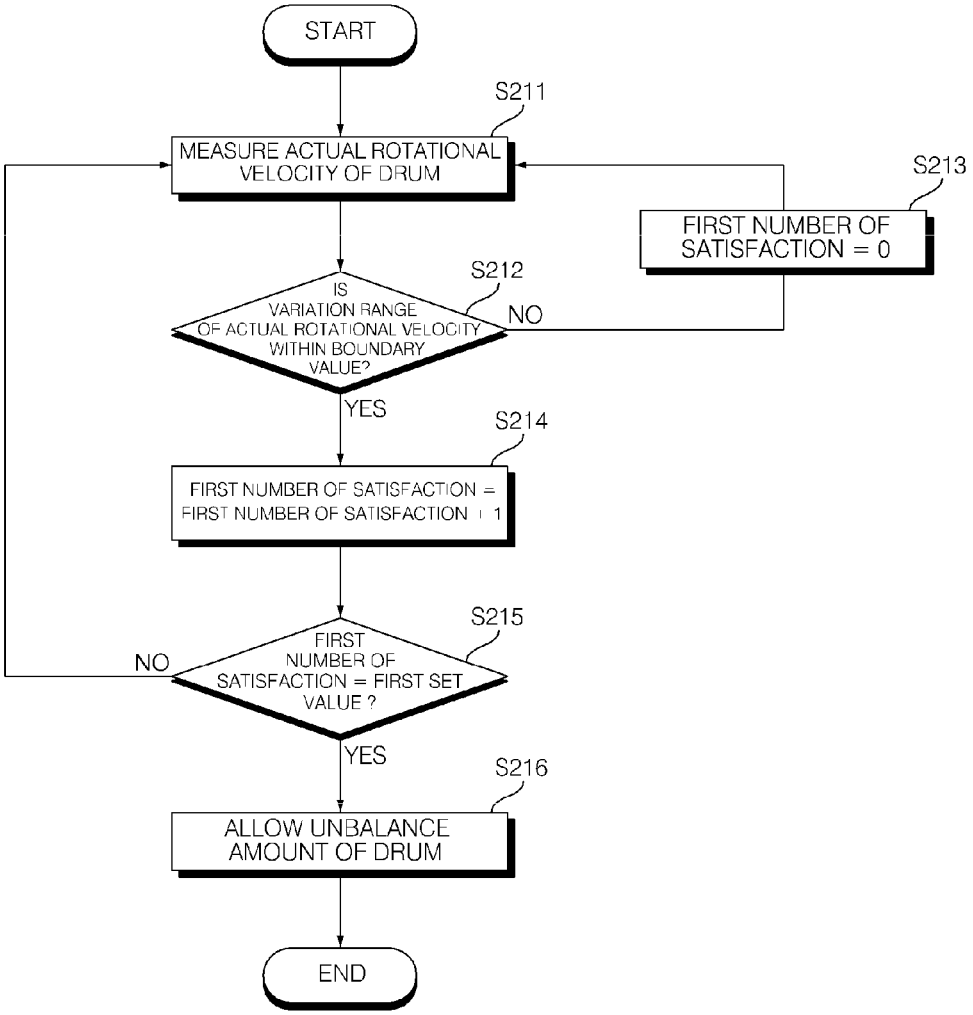
FIG. 5 is a flowchart illustrating a method of judging unbalance of a drum in first unbalance judgment of the control method of the washing machine in accordance with the embodiment of the present invention.
Figure 6:
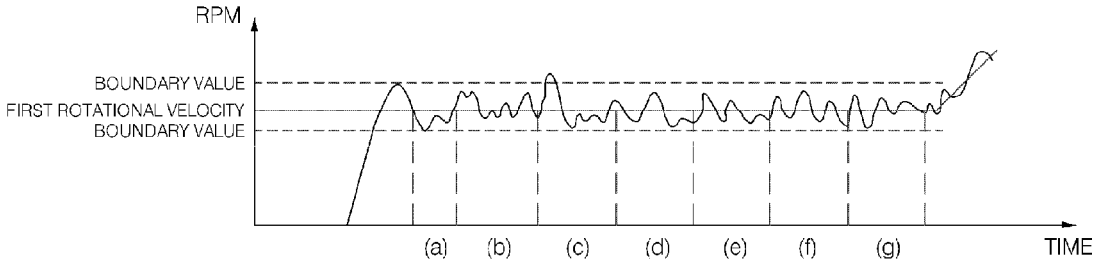
FIG. 6 is a graph illustrating the actual rotational velocity of the drum during the unbalance judgment of the drum shown in FIG. 5.

FIG. 5 is a flowchart illustrating a method of judging unbalance of the drum in the first unbalance judgment of the control method of the washing machine in accordance with the embodiment of the present invention and FIG. 6 is a graph illustrating the actual rotational velocity of the drum during the unbalance judgment of the drum shown in FIG. 5.

With reference to FIG. 5, in the first unbalance judgment (Operation 210), when the controller 141 controls the motor 113 to rotate the drum 124 at the first rotational velocity, the velocity detection unit 142 measures the actual rotational velocity of the drum 124 (Operation S211). The velocity detection unit 142 measures the actual rotational velocity of the drum 124 and outputs the measured actual rotational velocity to the controller 141. The controller 141 sets the first number of satisfaction N1 to 0 when the drum 124 starts rotation at the first rotational velocity. The first rotational velocity may be a velocity at which the drum 124 is rotated under the condition that the laundry received in the drum 124 is not attached to the drum 124. In this embodiment, the first rotational velocity is 46 rpm.

The controller 141 may judge the first unbalance amount of the drum 124 after the controller 141 waits for a set waiting time from when the drum 124 starts rotation at the first rotational velocity. Since the variation range of the rotational velocity of the drum 124 may be great after the controller 141 controls the motor 113 to accelerate the drum 124 and thus the drum 124 reaches the first rotational velocity, the controller 141 may have the set waiting time shown in section (a) of FIG. 6.

The controller 141 measures a time after the set waiting time has elapsed and judges whether or not the measured time exceeds a first unbalance judgment time. During a subsequent process of performing respective operations, when the measured time exceeds the first unbalance judgment time, the controller 141 judges that the first unbalance amount is not allowed in the first unbalance judgment (Operation 210).

The controller 141 judges whether or not the variation range of the actual rotational velocity of the drum 124 is within a set boundary value (Operation S212). The controller 141 judges whether or not the variation range of the actual rotational velocity of the drum 124 measured by the velocity detection unit 142 is within the boundary value for a set time interval. Since the variation range of the actual rotational velocity may have a positive (+) or negative (−) value based on the first rotational velocity, the controller 141 may judge whether or not a judgment equation below is satisfied.

$$|(\text{actual rotational velocity})-(\text{first rotational velocity})| < \text{boundary value}$$

According to embodiments, the controller 141 may judge whether or not the variation range of the actual rotational velocity of the drum 124 is within the set boundary value by performing low-pass filtering of the actual rotational velocity of the drum 124 measured by the velocity detection unit 142 for the set time interval based on the boundary value or by subtracting the boundary value from the actual rotational velocity and calculating the moving average value.

The boundary value is predetermined and stored in the controller 141, and may be changed according to the amount of laundry received in the drum 124 according to embodiments.

When the variation range of the actual rotational velocity of the drum 124 is within the boundary value for the set time interval, the controller 141 increases the first number of satisfaction N1 by 1 (Operation S214). As exemplarily shown in section (b) of FIG. 6, when the variation range of the actual rotational velocity of the drum 124 is within the boundary value for the set time interval, the controller 141 increases the first number of satisfaction N1 by 1. Since the first number of satisfaction N1 is set to 0 when the first unbalance judgment (Operation 210) is started, the first number of satisfaction N1 in section (b) becomes 1.

The controller 141 judges whether or not the first number of satisfaction N1 is a first set value (Operation S215). In order to judge whether or not the variation range of the actual rotational velocity of the drum 124 is continuously within the boundary value by the predetermined number of times, the controller 141 judges whether or not the first number of satisfaction N1 is the predetermined first set value. As the first set value increases, accuracy in judgment of the first unbalance amount increases but the first unbalance judgment time increases. In this embodiment, the first set value may be 4.

When the first number of satisfaction N1 is not the first set value, the controller 141 measures the actual rotational velocity of the drum 124 again (Operation S211) and judges whether or not the variation range of the actual rotational velocity of the drum 124 is within the boundary value for the set time interval again (Operation S212). The controller 141 judges whether or not the variation range of the actual rotational velocity of the drum 124 is within the boundary value by the set time interval until the first number of satisfaction N1 reaches the first set value.

In section (b) of FIG. 6, the first number of satisfaction N1 is 1 and thus, the controller 141 measures the actual rotational velocity of the drum 124 again (Operation S211) and judges whether or not the variation range of the actual rotational velocity of the drum 124 is within the boundary value for the set time interval again (Operation S212). In the repeated process, the set time interval may be uniform.

When the variation range of the actual rotational velocity of the drum 124 is not within the boundary value for the set time interval, the controller 141 sets the first number of satisfaction N1 to 0 (Operation S213), measures the actual rotational velocity of the drum 124 again (Operation S211), and judges whether or not the variation range of the actual rotational velocity of the drum 124 is within the boundary value for the set time interval again (Operation S212). When the variation range of the actual rotational velocity of the drum 124 is not within the boundary value for the set time interval, the controller 141 judges whether or not the variation range of the actual rotational velocity of the drum 124 is continuously within the boundary value by the predetermined number of times corresponding to the first set value by setting the first number of satisfaction N1 to 0.

In section (c) of FIG. 6, the variation range of the actual rotational velocity of the drum 124 is the boundary value or more for the set time interval and thus, the controller sets the first number of satisfaction having the value of 1 to 0 (Operation S213), measures the actual rotational velocity of the drum 124 again (Operation S211), and judges whether or not the variation range of the actual rotational velocity of the drum 124 is within the boundary value for the set time interval again (Operation S212).

In section (d) of FIG. 6, the variation range of the actual rotational velocity of the drum 124 is within the boundary value for the set time interval and thus, the first number of satisfaction N1 becomes 1 again. In sections (e), (f), and (g) of FIG. 6, the variation range of the actual rotational velocity of the drum 124 is within the boundary value for the set time interval and thus, the first number of satisfaction N1 gradually increases by 1 and the first number of satisfaction N1 in section (g) of FIG. 6 becomes the first set value, i.e., 4.

When the first number of satisfaction N1 is the first set value, the controller 141 allows the first unbalance amount of the drum 124 (Operation S216). As described above, the controller 141 judges whether or not the variation range of the actual rotational velocity of the drum 124 is within the boundary value at the set time intervals and allows the first unbalance amount of the drum 124, when the number of times the variation range of the actual rotational velocity of the drum 124 is continuously within the boundary value is the first set value.

When the first unbalance amount of the drum 124 is allowed, the above-described second unbalance judgment (Operation 220) is performed. When the first unbalance amount of the drum 124 is allowed within the first unbalance judgment time, the controller 141 performs the second unbalance judgment (Operation 220) by immediately accelerating the drum 124 regardless of the first unbalance judgment time.

Figure 7:
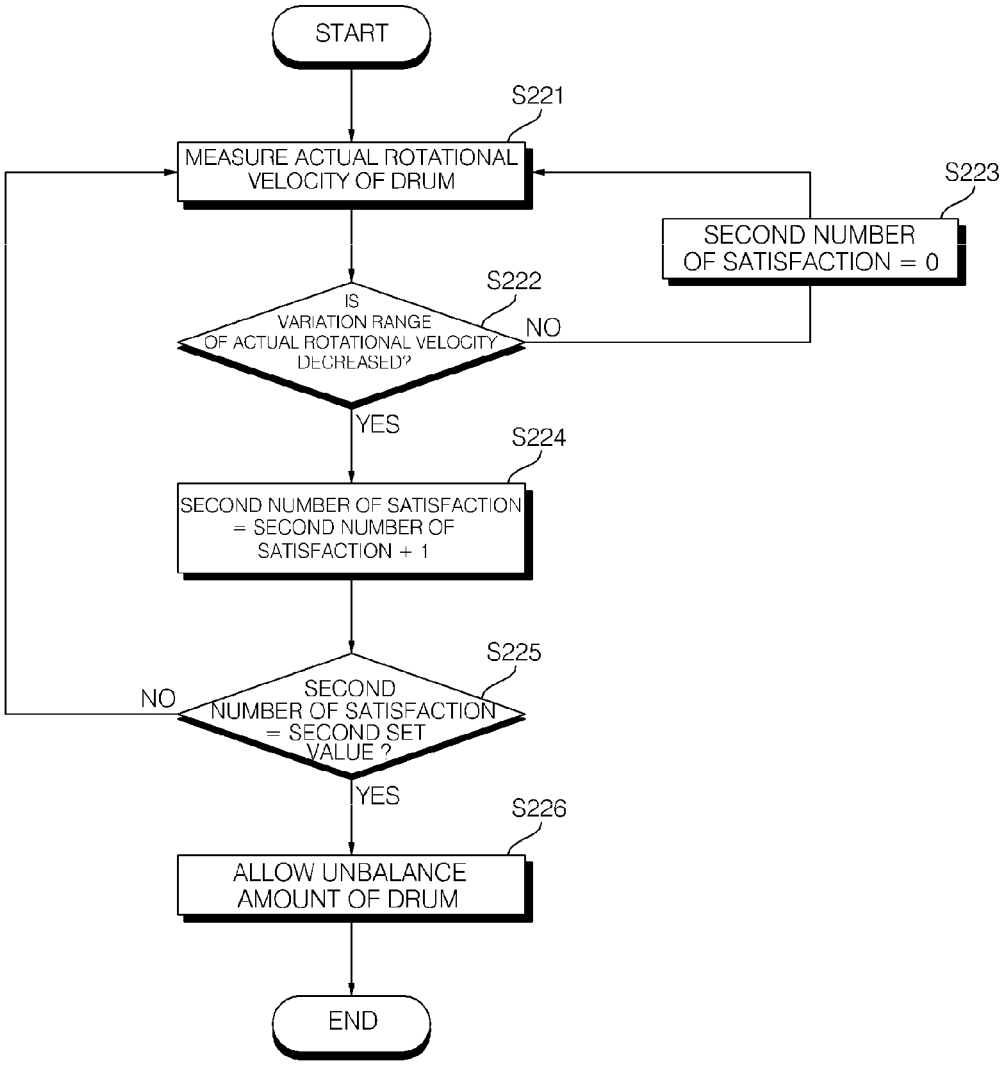
FIG. 7 is a flowchart illustrating a method of judging unbalance of the drum in second unbalance judgment of the control method of the washing machine in accordance with the embodiment of the present invention.

FIG. 7 is a flowchart illustrating a method of judging unbalance of the drum in second unbalance judgment of the control method of the washing machine in accordance with the embodiment of the present invention.

In the second unbalance judgment (Operation 220), the controller 141 controls the motor 113 to accelerate the drum 124 to the second rotational velocity, and the velocity detection unit 142 measures the actual rotational velocity of the drum 124 for a set time (Operation S221). According to embodiments, the controller 141 may control the motor 113 according to an acceleration set in the second unbalance judgment (Operation 220) to accelerate the drum 124.

The velocity detection unit 142 measures the actual rotational velocity of the drum 124 for the set time and outputs the measured actual rotational velocity of the drum 124 to the controller 141. The controller 141 sets the second number of satisfaction N2 to 0 when the drum 124 starts acceleration from the first rotational velocity.

The second rotational velocity may be a velocity at which the drum 124 is rotated under the condition that the laundry received in the drum 124 is attached to the drum 124. In this embodiment, the second rotational velocity is 130 rpm. During a subsequent process of performing respective operations, when the rotational velocity of the drum 124 exceeds the second rotational velocity, the controller 141 judges that the second unbalance amount is not allowed in the second unbalance judgment (Operation 220).

The controller 141 judges whether or not the variation range of the actual rotational velocity of the drum 124 is decreased (Operation S223). The controller 141 judges whether or not the variation range of the actual rotational velocity of the drum 124 measured for a set time interval is decreased from the former variation range of the actual rotational velocity of the drum 124 measured for the set time interval. The set time interval in the second unbalance judgment (Operation 220) may be equal to or differ from the set time interval in the first unbalance judgment (Operation 210).

The controller 141 may judge whether or not the variation range of the actual rotational velocity of the drum 124 measured for the set time interval is decreased by calculating the average value of the variation range of the actual rotational velocity of the drum 124 measured for the set time interval or calculating the maximum value of the variation range of the actual rotational velocity of the drum 124 measured for the set time interval.

When the variation range of the actual rotational velocity of the drum 124 measured for the set time interval is decreased from the former measured variation range of the actual rotational velocity of the drum 124, the controller 141 increases the second number of satisfaction N2 by 1 (Operation S224). When the variation range of the actual rotational velocity of the drum 124 measured for the set time interval is decreased from the former variation range of the actual rotational velocity of the drum 124 for the set time interval, the controller 141 increases the second number of satisfaction N2 by 1.

When the variation range of the actual rotational velocity of the drum 124 is not decreased from the former variation range of the actual rotational velocity of the drum 124, the controller 141 sets the second number of satisfaction N2 to 0 (Operation S223), measures the actual rotational velocity of the drum 124 again (Operation S221), and judges whether or not the variation range of the actual rotational velocity of the drum 124 is decreased again (Operation S222). When the variation range of the actual rotational velocity of the drum 124 for the set time interval is not decreased, the controller 141 judges whether or not the variation range of the actual rotational velocity of the drum 124 is continuously decreased by the number of times corresponding to a second set value by setting the second number of satisfaction N2 to 0.

The controller 141 judges whether or not the second number of satisfaction N2 is the second set value (Operation S225). In order to judge whether or not the variation range of the actual rotational velocity of the drum 124 is continuously decreased by the set number of times, the controllers judges whether or not the second number of satisfaction N2 is the predetermined second set value. As the second set value increases, accuracy in judgment of the second unbalance amount increases but the second unbalance judgment time increases.

When the second number of satisfaction N2 is not the second set value, the controller 141 measures the actual rotational velocity of the drum 124 again (Operation S221) and judges whether or not the variation range of the actual rotational velocity of the drum 124 is decreased (Operation S222).

When the second number of satisfaction N2 is the second set value, the controller 141 allows the second unbalance amount of the drum 124 (Operation S226). As described above, the controller 141 judges whether or not the variation range of the actual rotational velocity of the drum 124 is decreased at the set time intervals and allows the second unbalance amount of the drum 124 when the number of times the variation range of the actual rotational velocity of the drum 124 is continuously decreased is the second set value.

When the second unbalance amount of the drum 124 is allowed, the above-described acceleration (Operation 240) is performed. When the second unbalance amount of the drum 124 is allowed before the drum 124 reaches the second rotational velocity, the controller 141 performs the acceleration (Operation 240) by immediately accelerating the drum 124.

When the second unbalance amount of the drum 124 is not allowed until the drum 124 reaches the second rotational velocity, the controller 141 performs the third unbalance judgment (Operation 230).

A method of judging the third unbalance amount in the third unbalance judgment (Operation 230) is the same as the method of judging the second unbalance amount in the second unbalance judgment (Operation 220) shown in FIG. 7. However, a set time interval and a third set value in the method of judging the third unbalance amount in the third unbalance judgment (Operation 230) may differ from the set time interval and the second set value in the method of judging the second unbalance amount in the second unbalance judgment (Operation 220).

As apparent from the above description, a washing machine and a control method thereof in accordance with one embodiment of the present invention have at least one of effects below.

First, since the balance amount of a drum is judged while the drum is rotated at a regular velocity and then, the balance amount of the drum is judged while the drum is accelerated, a balancing time may be reduced and accuracy in judgment of the balance amount of the drum may be increased.

Second, the balance amount of the drum is judged while the drum is accelerated and thus, whether or not the drum is balanced may be efficiently judged.

Third, when the balance amount of the drum is judged while the drum is accelerated, when an unbalance amount of the drum is not allowed within a set time, the balance amount of the drum is judged while the acceleration of the drum is decreased and thus, accuracy in judgment of the balance amount of the drum may be increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A control method of a washing machine comprising:

sensing a first unbalance amount of a drum in which laundry is received while rotating the drum at a first rotational velocity;

determining whether or not the first unbalance amount of the drum is allowed;

decelerating the drum and accelerating the drum to the first rotational velocity, when the first unbalance amount is not allowed within a first unbalance judgment time;

sensing a second unbalance amount of the drum while accelerating the drum to a second rotational velocity, when the first unbalance amount is allowed;

determining whether or not the second unbalance amount of the drum is allowed;

accelerating the drum to a target rotational velocity, when the second unbalance amount is allowed;

sensing a third unbalance amount of the drum while accelerating the drum to a third rotational velocity, when the second unbalance amount is not allowed until the drum reaches the second rotational velocity;

accelerating the drum to the target rotational velocity, when the third unbalance amount is allowed; and decelerating the drum and sensing a first unbalance amount of a drum in which laundry is received while rotating the drum at the first rotational velocity, when the third unbalance amount is not allowed until the drum reaches the third rotational velocity.

2. The control method according to claim 1, wherein the sensing of the first unbalance amount includes:

measuring the actual rotational velocity of the drum while rotating the drum at the first rotational velocity;

judging whether or not the variation range of the actual rotational velocity is within a boundary value at pre-set time intervals; and allowing the first unbalance amount when the number of times the variation range of the actual rotational velocity is continuously within the boundary value is a pre-set value.

3. The control method according to claim 1, wherein the first rotational velocity is a velocity at which the drum is rotated under the condition that the laundry received in the drum is not attached to the drum.

4. The control method according to claim 3, wherein the first rotational velocity is 46 rpm.

5. The control method according to claim 1, wherein the second rotational velocity is a velocity at which the drum is rotated under the condition that the laundry received in the drum is attached to the drum.

6. The control method according to claim 5, wherein the second rotational velocity is 130 rpm.

7. The control method according to claim 1, wherein the sensing of the second unbalance amount includes:

measuring the actual rotational velocity of the drum while accelerating the drum to the second rotational velocity;

judging whether or not the variation range of the actual rotational velocity is continuously decreased at pre-set time intervals; and allowing the second unbalance amount when the number of times the variation range of the actual rotational velocity is continuously decreased is a pre-set value.

8. The control method according to claim 1, wherein the acceleration rate of the drum when the third unbalance amount is sensed is lower than the acceleration rate of the drum when the second unbalance amount is sensed.

9. The control method according to claim 1, wherein the sensing of the third unbalance amount includes:

measuring the actual rotational velocity of the drum while accelerating the drum to the third rotational velocity;

judging whether or not the variation range of the actual rotational velocity is continuously decreased at pre-set time intervals; and allowing the third unbalance amount when the number of times the variation range of the actual rotational velocity is continuously decreased is a pre-set value.

10. The control method according to claim 1, wherein the third rotational velocity is higher than the second rotational velocity.

11. The control method according to claim 10, wherein the third rotational velocity is 150 rpm.

* * * * *